US008907757B2

(12) United States Patent
Kato

(10) Patent No.: US 8,907,757 B2
(45) Date of Patent: Dec. 9, 2014

(54) COMMON MODE CHOKE COIL AND HIGH-FREQUENCY ELECTRONIC DEVICE

(71) Applicant: Murata Manufacturing Co., Ltd., Nagaokakyo-shi, Kyoto-fu (JP)

(72) Inventor: Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/266,956

(22) Filed: May 1, 2014

(65) Prior Publication Data

US 2014/0232501 A1 Aug. 21, 2014

Related U.S. Application Data

(63) Continuation of application No. PCT/JP2012/078122, filed on Oct. 31, 2012.

(30) Foreign Application Priority Data

Nov. 4, 2011 (JP) ..... 2011-242035

(51) Int. Cl.
*H01F 5/00* (2006.01)

(52) U.S. Cl.
USPC ..... 336/200

(58) Field of Classification Search
USPC ..... 336/65, 83, 200, 232–234
See application file for complete search history.

(56) References Cited

U.S. PATENT DOCUMENTS

| | | | | |
|---|---|---|---|---|
| 5,552,756 | A * | 9/1996 | Ushiro | 336/200 |
| 2007/0199734 | A1* | 8/2007 | Kudo et al. | 174/255 |
| 2011/0007439 | A1 | 1/2011 | Asakawa et al. | |
| 2014/0176287 | A1* | 6/2014 | Kato | 336/200 |

FOREIGN PATENT DOCUMENTS

| | | | |
|---|---|---|---|
| JP | 2000-331833 | A | 11/2000 |
| JP | 2000-348940 | A | 12/2000 |
| JP | 2001-284127 | A | 10/2001 |
| JP | 2003-068528 | A | 3/2003 |
| JP | 2004-311829 | A | 11/2004 |
| JP | 2005-064077 | A | 3/2005 |
| JP | 2007-066973 | A | 3/2007 |
| JP | 2007-181169 | A | 7/2007 |
| JP | 2007-200923 | A | 8/2007 |
| JP | 2008-098625 | A | 4/2008 |

(Continued)

OTHER PUBLICATIONS

Official Communication issued in International Patent Application No. PCT/JP2012/078122, mailed on Feb. 5, 2013.

(Continued)

*Primary Examiner* — Tuyen Nguyen
(74) *Attorney, Agent, or Firm* — Keating & Bennett, LLP

(57) ABSTRACT

A common mode choke coil includes a primary coil and a secondary coil, wherein the primary coil includes a first coil pattern and a second coil pattern connected in series to the first coil pattern, and the secondary coil includes a third coil pattern and a fourth coil pattern connected in series to the third coil pattern. The first and third coil patterns are concentrically wound, as parallel or substantially parallel lines, in loop shapes on one surface, and the second and fourth coil patterns are concentrically wound, as parallel or substantially parallel lines, in loop shapes on the one surface with being adjacent to the first and third coil patterns.

18 Claims, 7 Drawing Sheets

(56) References Cited

FOREIGN PATENT DOCUMENTS

| | | | |
|---|---|---|---|
| JP | 2008-277695 | A | 11/2008 |
| JP | 2009-004606 | A | 1/2009 |
| JP | 2011-018756 | A | 1/2011 |

OTHER PUBLICATIONS

Official Communication issued in corresponding Japanese Patent Application No. 2013-541805, mailed on Jun. 24, 2014.

Official Communication issued in corresponding Japanese Patent Application No. 2013-541805, mailed on Feb. 18, 2014.

* cited by examiner

COMMON MODE CHOKE COIL AND HIGH-FREQUENCY ELECTRONIC DEVICE

BACKGROUND OF THE INVENTION

1. Field of the Invention

The present invention relates to a common mode choke coil and a high-frequency electronic device including the common mode choke coil.

2. Description of the Related Art

In the past, in a high-speed interface such as a universal serial bus (USB) or a high definition multimedia interface (HDMI), there has been used a differential transmission method where signals whose phases differ by 180 degrees are transmitted using a pair of signal lines. In the differential transmission method, a radiation noise and an exogenous noise are cancelled out by a balanced line. Therefore, the differential transmission method is insusceptible to these noises. However, in a signal line for a high-speed interface, from a practical perspective, a noise current of a common mode based on the asymmetry property of the signal lines occurs. Therefore, a common mode choke coil that suppresses such a common mode noise is used.

Usually, as described in Japanese Unexamined Patent Application Publication No. 2003-068528 or Japanese Unexamined Patent Application Publication No. 2008-098625, the common mode choke coil is configured as a small-sized stacked type chip component including two coils (a primary coil and a secondary coil) wound in a same direction. The primary coil and the secondary coil are symmetrically arranged parallel to each other in a stacking direction within a multilayer body.

However, in such a common mode choke coil, the primary coil and the secondary coil are arranged to overlap with each other in the stacking direction. Therefore, owing to a problem in a manufacturing process (a position displacement, a stacking displacement, or the like of a coil) or a structural problem (when being mounted in a printed wiring board, a coupling amount between each coil and the ground of the printed wiring board is different), a symmetry property is lost. If the symmetry property of the primary coil and the secondary coil is lost, a removal capability for the common mode noise is reduced.

On the other hand, in a common mode choke coil of the related art, in many cases, a magnetic substance is used as a multilayer body. However, since the magnetic substance has a relatively large frequency characteristic, in particular a loss of a normal mode signal in a high-frequency band is likely to become large. In addition, in a case where a sufficient coupling value is not obtained between the primary coil and the secondary coil, the loss of the normal mode signal is likely to become large.

SUMMARY OF THE INVENTION

Accordingly, preferred embodiments of the present invention provide a common mode choke coil and a high-frequency electronic device where a loss of a normal mode signal is small and a removal capability for a common mode noise in a high-frequency band is high.

A common mode choke coil according to a preferred embodiment of the present invention includes a primary coil and a secondary coil, wherein the primary coil includes a first coil pattern and a second coil pattern connected in series to the first coil pattern, the secondary coil includes a third coil pattern and a fourth coil pattern connected in series to the third coil pattern, the first coil pattern and the third coil pattern are concentrically wound, as parallel or substantially parallel lines, in loop shapes on one surface, and the second coil pattern and the fourth coil pattern are concentrically wound, as parallel or substantially parallel lines, in loop shapes on the one surface with being adjacent to the first coil pattern and the third coil pattern.

A high-frequency electronic device according to another preferred embodiment of the present invention includes the above-mentioned common mode choke coil.

In the above-mentioned common mode choke coil, the first coil pattern and the third coil pattern are concentrically wound, as parallel or substantially parallel lines, in loop shapes on one surface, and the second coil pattern and the fourth coil pattern are concentrically wound, as parallel or substantially parallel lines, in loop shapes on the one surface with being adjacent to the first coil pattern and the third coil pattern. Therefore, the symmetry property thereof is prevent from being lost. In other words, in a manufacturing process, a position displacement or a stacking displacement is prevented from occurring in the coil pattern, and a difference is prevented from occurring in a coupling amount between each coil and a ground when being mounted in a printed wiring board. In addition, based on such a configuration, the degree of coupling between the primary coil and the secondary coil becomes high, a large inductance value is obtained in a common mode, and impedance becomes high. On the other hand, since, in a normal mode, an inductance value is small, the impedance is small. Accordingly, the loss of a normal mode signal is small and a removal capability for a common mode noise in a high-frequency band is improved.

According to a preferred embodiment of the present invention, it is possible to obtain a common mode choke coil where a loss of a normal mode signal is small and a removal capability for a common mode noise in a high-frequency band is high.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 2A illustrates a lowermost layer, and FIG. 2B illustrates a first layer from a bottom.

FIG. 3A illustrates a second layer from the bottom, and FIG. 3B illustrates a third layer from the bottom.

DETAILED DESCRIPTION OF THE PREFERRED EMBODIMENTS

Hereinafter, examples of a common mode choke coil and a high-frequency electronic device according to preferred embodiments of the present invention will be described with reference to accompanying drawings. In addition, in each diagram, a same symbol will be assigned to a component or portion in common, and redundant description will be omitted.

Figure 1:
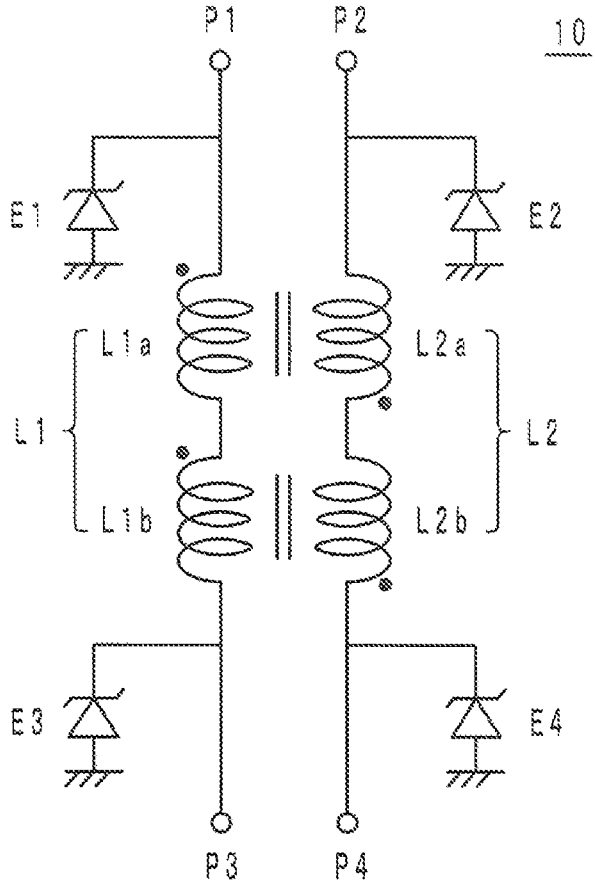
FIG. 1 is an equivalent circuit diagram illustrating a common mode choke coil serving as one example of a preferred embodiment of the present invention.

As illustrated in FIG. 1, a common mode choke coil 10 serving as one example of a preferred embodiment of the present invention includes, as equivalent circuits, a primary coil L1 and a secondary coil L2 coupled to each other through an electromagnetic field. The primary coil L1 includes a coil pattern L1*a* and a coil pattern L1*b* connected in series to the coil pattern L1*a*, and the secondary coil L2 includes a coil pattern L2*a* and a coil pattern L2*b* connected in series to the coil pattern L2*a*.

As illustrated in FIG. 2B, FIGS. 3A and 3B, and FIG. 4, each of the coil patterns L1*a*, L2*a*, L1*b*, and L2*b* is provided over four layers of base material layers 15 to 18, and configured as a stacked-type coil interlayer-connected based on via hole conductors. In detail, the coil pattern L1*a* and the coil pattern L2*a* are concentrically wound, as parallel or substantially parallel lines, in loop shapes (in a sense of being planar bifilar) in a region X1 on a surface of each of the base material layers 15 to 18, and the coil pattern L1*b* and the coil pattern L2*b* are concentrically wound, as parallel or substantially parallel lines, in loop shapes (in a sense of being planar bifilar) in a region X2 on the surface of each of the base material layers 15 to 18 with being adjacent to the coil patterns L1*a* and L2*a*. In other words, the winding axes of the coil patterns L1*a* and L2*a* extend in a stacking direction and approximately overlap with each other. The winding axes of the coil patterns L1*b* and L2*b* extend in the stacking direction and approximately overlap with each other.

As for connections between layers, end portions 21*a* and 22*a* of the coil patterns L1*a* and L2*a* on the uppermost layer are connected, through via hole conductors 31*a* and 32*a*, respectively, to respective end portions of the coil patterns L1*a* and L2 on the third layer, and end portions 21*b* and 22*b* of the coil patterns L1*b* and L2*b* on the uppermost layer are connected, through via hole conductors 31*b* and 32*b*, respectively, to respective end portions of the coil patterns L1*b* and L2*b* on the third layer. Furthermore, end portions 23*a* and 24*a* of the coil patterns L1*a* and L2*a* on the third layer are connected, through via hole conductors 33*a* and 34*a*, respectively, to respective end portions of the coil patterns L1*a* and L2*a* on the second layer, and end portions 23*b* and 24*b* of the coil patterns L1*b* and L2*b* on the third layer are connected, through via hole conductors 33*b* and 34*b*, respectively, to respective end portions of the coil patterns L1*b* and L2*b* on the second layer.

Furthermore, end portions 25*a* and 26*a* of the coil patterns L1*a* and L2*a* on the second layer are connected, through via hole conductors 35*a* and 36*a*, respectively, to respective end portions of the coil patterns L1*a* and L2*a* on the first layer, and end portions 25*b* and 26*b* of the coil patterns L1*b* and L2*b* on the second layer are connected, through via hole conductors 35*b* and 36*b*, respectively, to respective end portions of the coil patterns L1*b* and L2*b* on the first layer. Furthermore, end portions 27*a* and 28*a* of the coil patterns L1*a* and L2*a* on the first layer are connected to a high-side input electrode P1 and a low-side input electrode P2 on the lowermost layer (a back surface side of a base material layer 15) through via hole conductors 37*a* and 38*a*, respectively, and end portions 27*b* and 28*b* of the coil patterns L1*b* and L2*b* on the first layer are connected to a high-side output electrode P3 and a low-side output electrode P4 on the lowermost layer (the back surface side of the base material layer 15) through via hole conductors 37*b* and 38*b*, respectively. The electrodes P1 and P2 are balanced input terminals, and the electrodes P3 and P4 are balanced output terminals.

Figure 4:
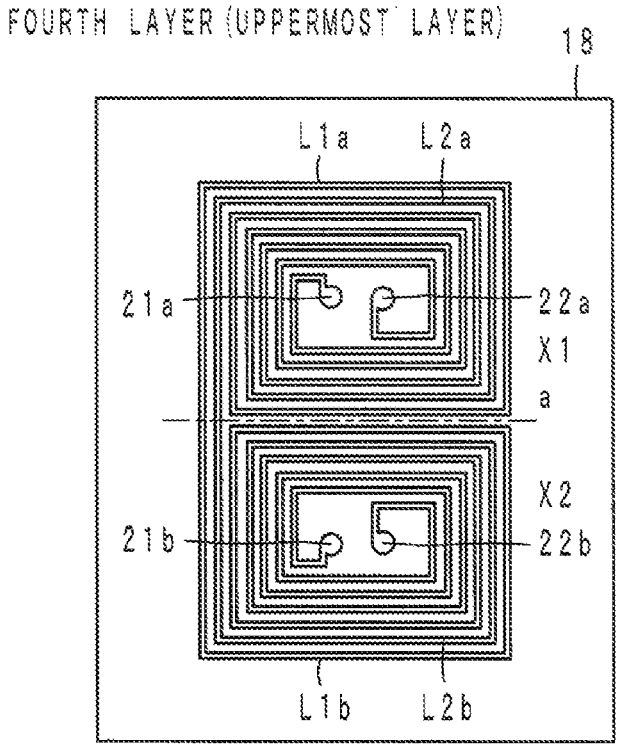
FIG. 4 is a plan view illustrating the stacked structure of the common mode choke coil, and illustrates a fourth layer (uppermost layer) from the bottom.

In addition, as illustrated in FIG. 4, on a base material layer 18 defining and serving as the uppermost layer, the coil pattern L1*a* and the coil pattern L1*b* are connected in series, and the coil pattern L2*a* and the coil pattern L2*b* are connected in series. In addition, the coil patterns L1*a*, L2*a*, L1*b*, and L2*b* located on each of the base material layers 15 to 18 are arranged so as not to overlap with coil patterns located on base material layers vertically adjacent thereto when viewed in plan.

A loop pattern including the coil pattern L1*a* and coil pattern L2*a* located in the region X1 and a loop pattern including the coil pattern L1*b* and coil pattern L2*b* located in the region X2 are subjected to patterning line-symmetrically or substantially line-symmetrically with centering around a line partitioning each of the base material layers 15 to 18 in a long side direction.

Figure 2A:
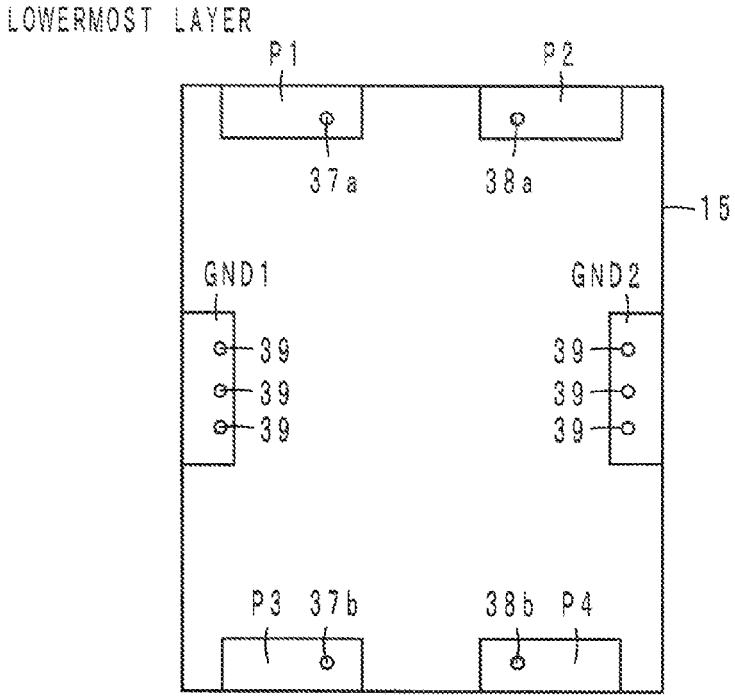
FIG. 2A and FIG. 2B are plan views illustrating a stacked structure of the common mode choke coil.
Figure 2B:
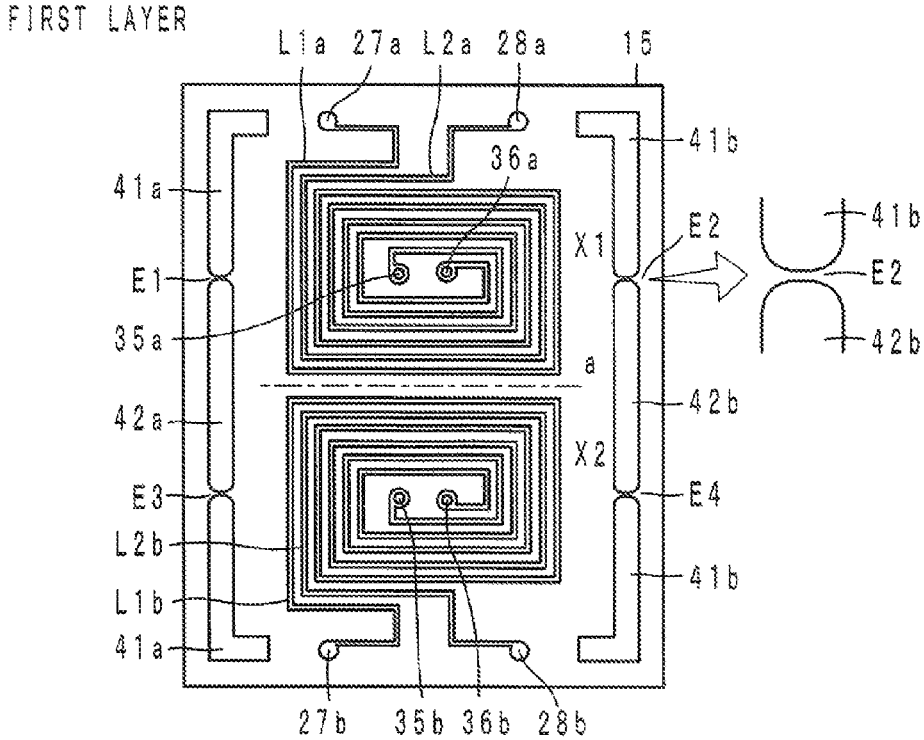
Figure 3A:
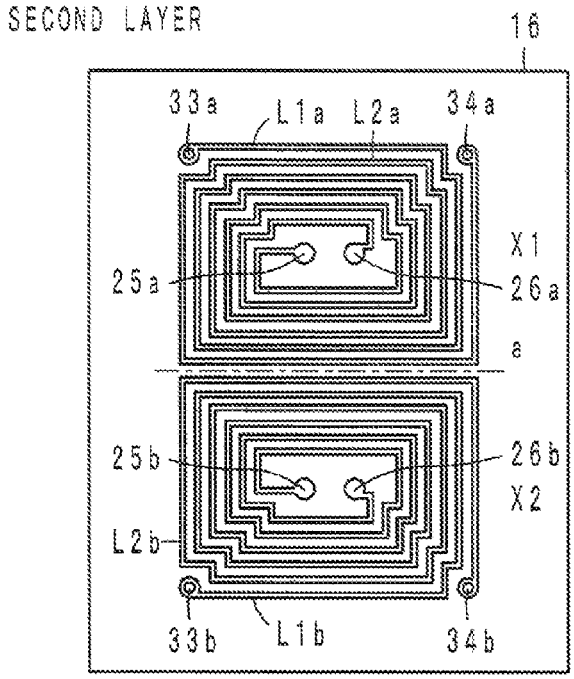
FIG. 3A and FIG. 3B are plan views illustrating the stacked structure of the common mode choke coil.
Figure 3B:
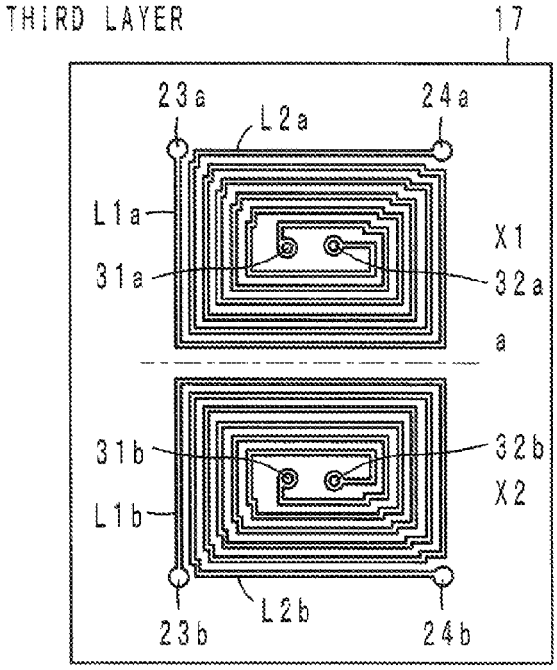

In addition, on the base material layer 15 defining and serving as the first layer, there is provided an electrostatic protection circuit including discharge gaps E1 to E4 configured by discharge electrodes 41*a*, 41*b*, 42*a*, and 42*b* of a plurality of pairs. Gaps of the discharge gaps E1 to E4 preferably are about 5 μm, for example. As illustrated in FIG. 2B, when viewed in plan, this electrostatic protection circuit is arranged so as to surround the coil patterns L1*a*, L2*a*, L1*b*, and L2*b*, and connected to ground electrodes GND1 and GND2 through via hole conductors 39 (see FIG. 2A).

Figure 5:
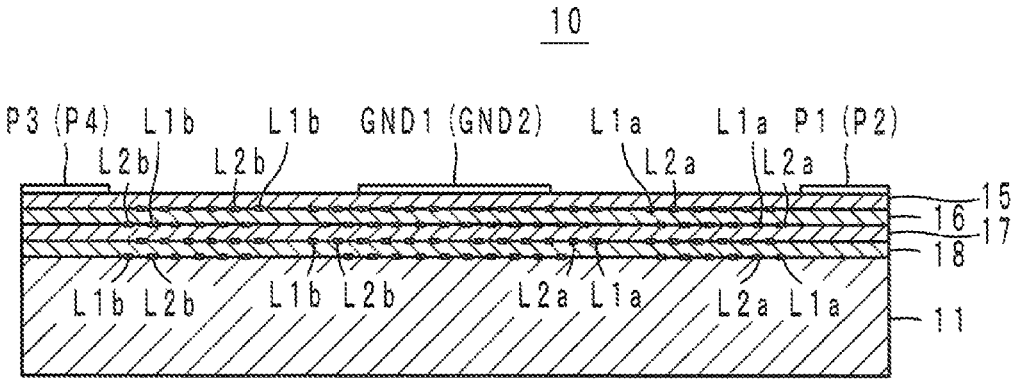
FIG. 5 is an explanatory diagram for a manufacturing process for the common mode choke coil, and illustrates a cross-section in a central portion of a multilayer body in a long side direction.
Figure 6:
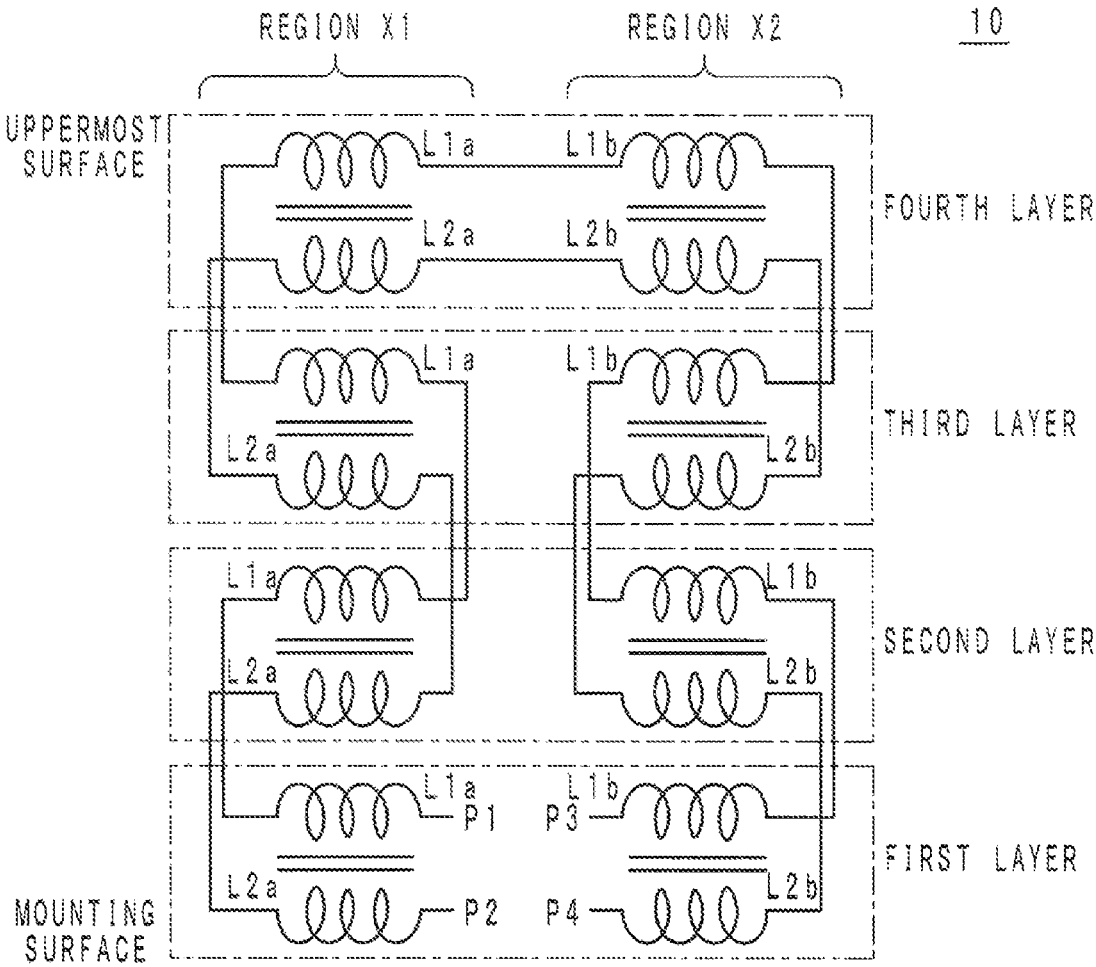
FIG. 6 is an explanatory diagram schematically illustrating the stacked structure of the common mode choke coil.

Here, a non-limiting example of a manufacturing process for configuring the primary coil L1 and the secondary coil L2 as stacked-type coils will be described with reference to FIG. 5. The base material layers 15 to 18 include dielectrics, and in respect of transmission characteristics, a low-dielectric constant material whose dielectric constant $\in$ is of about 3 to 10 is desirable in terms of the fact that the line-line capacitances of the coils L1 and L2 become small. In addition, the base material layers 15 to 18 may be magnetic substances, and in this case, it is desirable that a low-loss material, for example, hexagonal ferrite is used. The base material layers 15 to 18 may be layers in which manganese ferrite is mixed into a resin.

First, on a silicon substrate 11, based on a thin film process, the coil patterns L1*a*, L2*a*, L1*b*, and L2*b* to define and serve as the fourth layer are formed using, for example, Cu as a material. In other words, a metal film is preferably formed using plating, vapor deposition, sputtering, or the like, and the metal film is subjected to patterning so as to have a predetermined shape, using a photolithographic method. On that, an epoxy resin is applied to provide the base material layer 18. In this base material layer 18, via holes to define the via hole conductors 31*a*, 32*a*, 31*b*, and 32*b* are formed.

Furthermore, on the base material layer 18, based on a thin film process, the coil patterns L1*a*, L2*a*, L1*b*, and L2*b* to define and serve as the third layer are formed using Cu as a material. On that, an epoxy resin is applied to provide the base material layer 17. In this base material layer 17, via holes to define the via hole conductors 33*a*, 34*a*, 33*b*, and 34*b* are formed. Furthermore, on the base material layer 17, based on a thin film process, the coil patterns L1*a*, L2*a*, L1*b*, and L2*b* to serve as the second layer are preferably formed using Cu as a material. On that, an epoxy resin is applied to form the base material layer 16. In this base material layer 16, via holes to define the via hole conductors 35*a*, 36*a*, 35*b*, and 36*b* are formed.

Furthermore, on the base material layer 16, based on a thin film process, the coil patterns L1*a*, L2*a*, L1*b*, and L2*b* to define and serve as the first layer are formed using Cu as a material. At the same time, on the base material layer 16, the discharge electrodes 41*a*, 41*b*, 42*a*, and 42*b* are formed based on a thin film process. On that, an epoxy resin is applied to form the base material layer 15. In this base material layer 15, via holes to define the via hole conductors 37*a*, 38*a*, 37*b*, 38*b*, and 39 are formed. Furthermore, on the base material layer 15, the input electrodes P1 and P2, the output electrodes P3 and P4, and the ground electrodes GND1 and GND2 are formed based on a thin film process.

The thickness of each of the base material layers 15 to 18 formed using an epoxy resin preferably is about 10 μm, and the thickness of each of the coil patterns L1*a*, L2*a*, L1*b*, and L2*b*, the electrodes P1 to P4, GND1, and GND2, and the discharge electrodes 41*a*, 41*b*, 42*a*, and 42*b* formed using Cu preferably is about 4 μm, for example. In this regard, however, the types of material and the thicknesses are not limited to these.

In the common mode choke coil 10, the coil patterns L1*a* and L2*a* are concentrically wound, as parallel or substantially parallel lines, in loop shapes on each of the base material layers 15 to 18, and the coil patterns L1*b* and L2*b* are concentrically wound, as parallel or substantially parallel lines, in loop shapes on each of the base material layers 15 to 18 with being adjacent to the coil patterns L1*a* and L2*a*. Therefore, the symmetry property thereof is prevented from being lost. In other words, in a manufacturing process, a position displacement or a stacking displacement is prevented from occurring in the coil pattern, and a difference in a coupling amount between each of the coils L1 and L2 and a ground when being mounted in a printed wiring board is prevented from occurring. Based on such a configuration, the degree of coupling between the primary coil L1 and the secondary coil L2 becomes high, a large inductance value is obtained in a common mode, and impedance becomes high. On the other hand, since, in the normal mode, an inductance value is small, the impedance is small. Accordingly, the loss of a normal mode signal is small and a removal capability for a common mode noise in a high-frequency band is improved.

Figure 8:
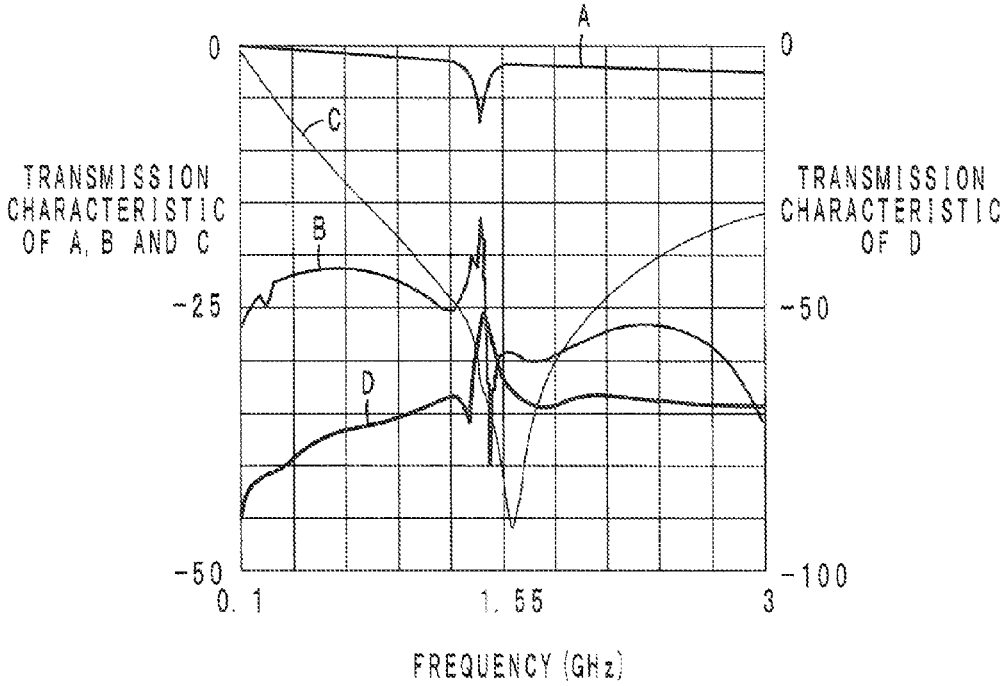
FIG. 8 is a graph illustrating characteristics of the common mode choke coil.
Figure 9:
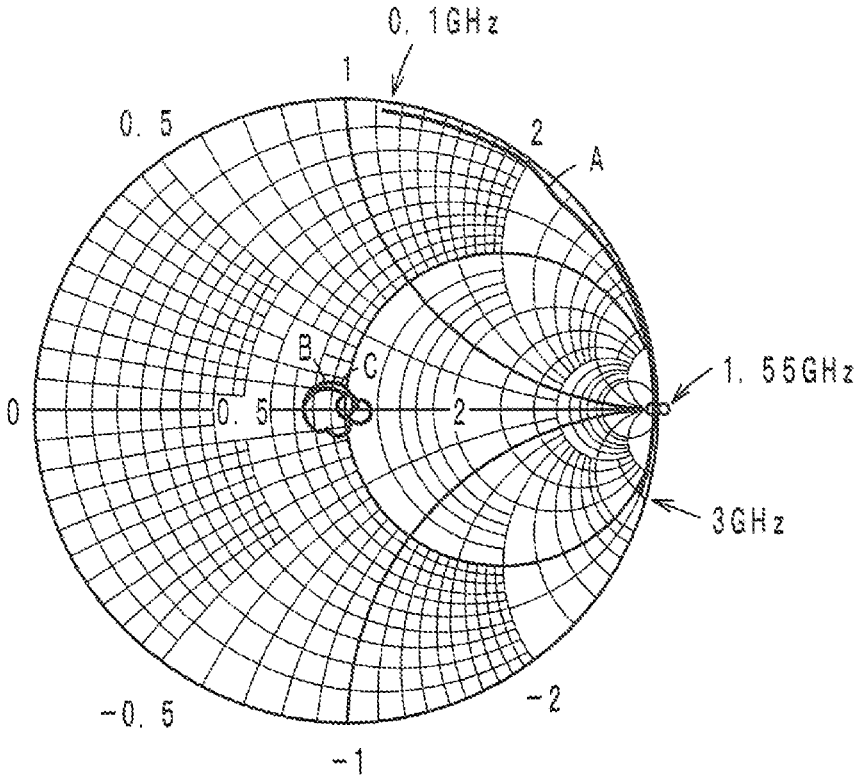
FIG. 9 is a Smith chart diagram illustrating characteristics of the common mode choke coil.

Pieces of data of characteristics are as illustrated in FIG. 8 and FIG. 9. In FIG. 8, a curved line A indicates the transmission characteristic of the normal mode signal, and the transmission characteristic thereof extends to about 3 GHz (and to about 5 GHz greater than or equal to that) without being attenuated. A curved line B indicates the reflection characteristic of the normal mode signal, a curved line C indicates the transmission (attenuation) characteristic of the common mode noise, and a curved line D indicates the transmission characteristic of the common mode noise superimposed on the normal mode signal. As is clear from these pieces of characteristic data, the common mode choke coil 10 exhibits a good characteristic in a high-frequency band from about 100 MHz to about 3 GHz, for example.

In addition, the impedance characteristic of the common mode signal is as indicated by a curved line A in FIG. 9, the impedance characteristic of the normal mode signal is as indicated by a curved line B in FIG. 9, and the impedance characteristic of the common mode noise is as indicated by a curved line C in FIG. 9. The curved lines B and C nearly overlap with each other. As is clear from FIG. 9, in a wide high-frequency band, the input impedance and output impedance of the normal mode signal become constant, and are able to be matched with the characteristic impedance of a transmission line.

Figure 7:
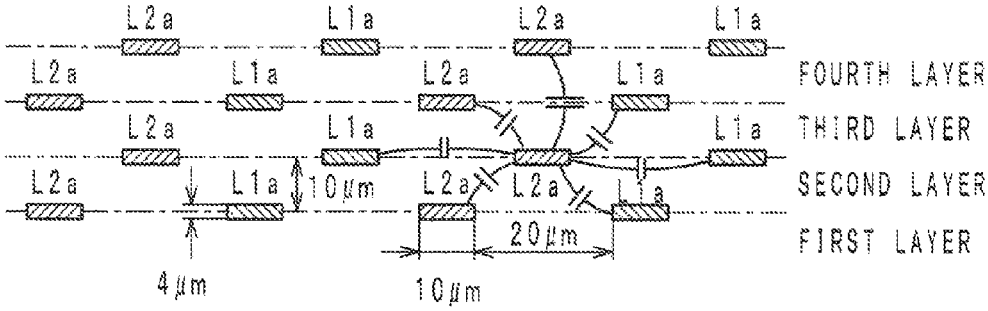
FIG. 7 is an explanatory diagram illustrating line-line capacitances occurring in the common mode choke coil.

In the stacked-type coil, in some cases, a parallel resonant circuit is formed based on stray capacitances occurring between coil patterns on individual layers, and adversely affects a transmission characteristic. In other words, the transmission characteristic (the curved line A) of the normal mode signal, illustrated in FIG. 8, is cut in the high-frequency band. In the present example, as illustrated in FIG. 7, the coil patterns L1*a*, L2*a*, L1*b*, and L2*b* provided on the base material layers vertically adjacent to each other are arranged so as not to overlap when viewed in plan. Therefore, a stray capacitance occurring between coil patterns becomes small, and it is possible to avoid a resonance point from being generated in a pass band. In addition, since a capacitance is generated between the primary coil L1 and the secondary coil L2 in a distributed manner, it is possible to significantly shift a cutoff frequency in the insertion loss characteristic of the normal mode signal (see the curved line A in FIG. 8) to a high frequency side.

Incidentally, in FIG. 7, the thickness of a coil pattern preferably is about 4 μm, the line width thereof preferably is about 10 μm, a gap between lines preferably is about 20 μm, and a gap between upper and lower layers (the thickness of a base material layer) preferably is about 10 μm, for example.

In addition, since the discharge electrodes 41*a*, 41*b*, 42*a*, and 42*b* preferably are arranged so as to surround the coil patterns L1*a*, L2*a*, L1*b*, and L2*b*, even if another electronic component is arranged around the common mode choke coil 10, the coil value of each of the coils L1 and L2 becomes hard to fluctuate.

The above-mentioned common mode choke coil 10 preferably is applied to parallel lines in the differential transmission method. In particular, in a high-frequency electronic device equipped with balanced lines for a high-speed interface such as USB or HDMI (high-speed differential transmission lines), the common mode choke coil 10 is used as a filter suppress the common mode noise.

In addition, the common mode choke coil and the high-frequency electronic device according to the present invention are not limited to the above-mentioned examples, and may be variously modified within the scope thereof.

In particular, the detail of a coil pattern configuring the primary coil or the secondary coil and a connection configuration between upper and lower layers are arbitrary.

As described above, preferred embodiments of the present invention are useful for a common mode choke coil and a high-frequency electronic device, and in particular, superior in that a loss of a normal mode signal is small and a removal capability for a common mode noise in a high-frequency band is high.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A common mode choke coil comprising:

a primary coil; and a secondary coil; wherein the primary coil includes a first coil pattern and a second coil pattern connected in series to the first coil pattern;

the secondary coil includes a third coil pattern and a fourth coil pattern connected in series to the third coil pattern;

the first coil pattern and the third coil pattern are concentrically wound, as parallel or substantially parallel lines, in loop shapes on one surface;

the second coil pattern and the fourth coil pattern are concentrically wound, as parallel or substantially parallel lines, in loop shapes on the one surface with being adjacent to the first coil pattern and the third coil pattern;

the first coil pattern, the second coil pattern, the third coil pattern, and the fourth coil pattern are stacked coils defined by interlayer-connecting coil patterns individually provided on a plurality of base material layers;

the first coil pattern and the second coil pattern are connected in series on an uppermost layer of the base material layers, and the third coil pattern and the fourth coil pattern are connected in series on the uppermost layer of the base material layers; and an end portion of each of the primary coil and the secondary coil is connected to an input-output electrode arranged only on a mounting surface defining a lowermost layer of the base material layers.

2. The common mode choke coil according to claim 1, wherein a first loop pattern including the first coil pattern and the third coil pattern and a second loop pattern including the second coil pattern and the fourth coil pattern are made of line-symmetrically or substantially line-symmetrically patterned material.

3. The common mode choke coil according to claim 1, wherein the base material layers are each made of a dielectric.

4. The common mode choke coil according to claim 1, wherein the base material layers are each made of a dielectric whose dielectric constant is about 3 to 10.

5. The common mode choke coil according to claim 1, wherein the coil patterns of the stacked coil patterns on each base material layer are arranged so as not to overlap with coil patterns located on base material layers vertically adjacent thereto when viewed in plan.

6. The common mode choke coil according to claim 1, further comprising an electrostatic protection circuit including a pair of discharge electrodes.

7. The common mode choke coil according to claim 6, wherein the electrostatic protection circuit surrounds the primary coil and the secondary coil when viewed in plan.

8. The common mode choke coil according to claim 6, wherein the electrostatic protection circuit is made of thin film processed material.

9. The common mode choke coil according to claim 1, wherein the primary coil and the secondary coil are made of thin film processed material.

10. A high-frequency electronic device comprising the common mode choke coil according to claim 1.

11. The high-frequency electronic device according to claim 10, wherein a first loop pattern including the first coil pattern and the third coil pattern and a second loop pattern including the second coil pattern and the fourth coil pattern are made of line-symmetrically or substantially line-symmetrically patterned material.

12. The high-frequency electronic device according to claim 10, wherein the base material layers are each made of a dielectric.

13. The high-frequency electronic device according to claim 10, wherein the base material layers are each made of a dielectric whose dielectric constant is about 3 to 10.

14. The high-frequency electronic device according to claim 10, wherein the coil patterns of the stacked coil patterns on each base material layer are arranged so as not to overlap with coil patterns located on base material layers vertically adjacent thereto when viewed in plan.

15. The high-frequency electronic device according to claim 10, further comprising an electrostatic protection circuit including a pair of discharge electrodes.

16. The high-frequency electronic device according to claim 15, wherein the electrostatic protection circuit surrounds the primary coil and the secondary coil when viewed in plan.

17. The high-frequency electronic device according to claim 15, wherein the electrostatic protection circuit is made of thin film processed material.

18. The high-frequency electronic device according to claim 10, wherein the primary coil and the secondary coil are made of thin film processed material.

* * * * *